US010389054B1

(12) United States Patent
Neumann et al.

(10) Patent No.: US 10,389,054 B1
(45) Date of Patent: Aug. 20, 2019

(54) CONTACT BLADE FOR A SOCKET-LIKE CONNECTOR PART, AND SOCKET-LIKE CONNECTOR PART

(71) Applicant: Kostal Kontakt Systeme GmbH, Leudenscheid (DE)

(72) Inventors: Wolfgang Neumann, Minden (DE); Thomas Scherer, Luedenscheid (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 16/378,682

(22) Filed: Apr. 9, 2019

Related U.S. Application Data

(63) Continuation of application No. PCT/EP2018/052109, filed on Jan. 29, 2018.

(30) Foreign Application Priority Data

Jan. 31, 2017 (DE) ..... 10 2017 001 166

(51) Int. Cl.
*H01R 13/11* (2006.01)

(52) U.S. Cl.
CPC ..... *H01R 13/112* (2013.01)

(58) Field of Classification Search
CPC ..... H01R 13/112; H01R 13/187
(Continued)

(56) References Cited

U.S. PATENT DOCUMENTS 4,553,799 A * 11/1985 Deters ..... H01R 31/085 439/507
5,613,885 A 3/1997 Plate et al.
(Continued)

FOREIGN PATENT DOCUMENTS

DE 4439105 C1 4/1996
DE 202004013160 U1 2/2005
(Continued)

OTHER PUBLICATIONS

European Patent Office, International Search Report for International Application No. PCT/EP2018/052109, dated Mar. 9, 2018.
(Continued)

*Primary Examiner* — Tulsidas C Patel
*Assistant Examiner* — Peter G Leigh
(74) *Attorney, Agent, or Firm* — Brooks Kushman P.C.

(57) ABSTRACT

A contact blade for a plug-in connector part includes oppositely situated first and second contact arms extending longitudinally. The first contact arm has a primary opening dividing the first contact arm into first and second contact webs on respective sides of the primary opening. The first contact web has a contact opening dividing the first contact web into inner and outer contact skids on respective sides of the contact opening. The inner contact skid is between the contact opening and the primary opening and the outer contact skid is between the contact opening and an edge of the first contact arm. The contact opening has a transverse bulge extending laterally toward the primary opening such that the outer contact skid has a widened section next to the transverse bulge. A contact point, for contacting a plug pin, is on the widened section of the outer contact skid.

20 Claims, 5 Drawing Sheets

(58) Field of Classification Search
USPC ..... 439/889, 845
See application file for complete search history.

(56) References Cited

U.S. PATENT DOCUMENTS

| | | | | |
|---|---|---|---|---|
| 5,868,590 | A * | 2/1999 | Dobbelaere | H01R 13/18 439/839 |
| 6,722,926 | B2 * | 4/2004 | Chevassmore | H01R 13/113 439/721 |
| 7,150,660 | B2 * | 12/2006 | Allgood | H01R 11/289 439/845 |
| 7,766,706 | B2 * | 8/2010 | Kawamura | H01R 13/112 439/833 |
| 7,892,050 | B2 * | 2/2011 | Pavlovic | H01R 9/245 439/250 |
| 8,128,441 | B2 * | 3/2012 | Mukuno | H01R 13/187 439/845 |
| 8,366,497 | B2 * | 2/2013 | Glick | H01R 9/245 439/839 |
| 8,475,220 | B2 * | 7/2013 | Glick | H01R 13/113 439/839 |
| 9,142,902 | B2 * | 9/2015 | Glick | H01R 13/18 |
| 9,166,322 | B2 * | 10/2015 | Glick | H01R 13/113 |
| 9,190,756 | B2 * | 11/2015 | Glick | H01R 13/18 |
| 9,548,553 | B2 * | 1/2017 | Glick | H01R 13/18 |
| 2004/0116002 | A1 | 6/2004 | Rozet et al. | |
| 2006/0252294 | A1 * | 11/2006 | Cvasa | H01R 13/187 439/252 |
| 2010/0124857 | A1 * | 5/2010 | Kawamura | H01R 13/112 439/816 |
| 2011/0045712 | A1 | 2/2011 | Mukuno | |
| 2011/0076901 | A1 * | 3/2011 | Glick | H01R 9/245 439/839 |
| 2014/0099843 | A1 | 4/2014 | Ito | |
| 2015/0038000 | A1 * | 2/2015 | Glick | H01R 13/113 439/370 |
| 2015/0038024 | A1 * | 2/2015 | Glick | H01R 13/18 439/862 |

FOREIGN PATENT DOCUMENTS

| | | | |
|---|---|---|---|
| DE | 20221168 | U1 | 5/2005 |
| DE | 102016007117 | A1 | 12/2017 |
| EP | 1215763 | A1 | 6/2002 |
| EP | 1643598 | A1 | 4/2006 |
| JP | 2011044256 | A | 3/2011 |

OTHER PUBLICATIONS

German Patent and Trademark Office, German Search Report for German Patent Application No. 10 2017 001 166.4 dated Dec. 12, 2017.

* cited by examiner

CONTACT BLADE FOR A SOCKET-LIKE CONNECTOR PART, AND SOCKET-LIKE CONNECTOR PART

CROSS-REFERENCE TO RELATED APPLICATIONS

This application is a continuation of International Application No. PCT/EP2018/052109, published in German, with an International filing date of Jan. 29, 2018, which claims priority to DE 10 2017 001 166.4, filed Jan. 31, 2017; the disclosures of which are hereby incorporated in their entirety by reference herein.

TECHNICAL FIELD

The present invention relates to a contact blade for a socket-like, plug-in connector part. The contact blade is formed from a sheet metal strip bent essentially in a U-shape. The legs of the U-shape metal strip form two oppositely situated contact arms. The contact arms approach one another in middle sections of their lengths. Each contact arm is divided into two parallel, adjacent contact webs by a primary opening extending over most of the length of the contact arm. In the area in which the contact arms are closest to one another, for each contact arm a contact opening is formed in each of the contact webs of the contact arm. The contact openings of each contact arm extend in the longitudinal direction parallel with the primary opening of the contact arm. The contact openings in each case are shorter than the primary opening. Consequently, for each contact opening, each contact web forms two contact skids on respective sides of the contact opening. The present invention further relates to a socket-like, plug-in connector part having such a contact blade.

BACKGROUND

This type of contact blade and socket-like, plug-in connector part having this type of contact blade are described in DE 10 2016 007 117 A1. DE 10 2016 007 117 A1 is the subject of FIGS. 4 and 6 herein.

DE 44 39 105 C1 (corresponding to U.S. Pat. No. 5,613,885) describes a contact blade which is formed from a sheet metal strip bent in a U-shape, thus forming two oppositely situated contact arms. Each contact arm is divided into two contact webs by a primary opening that is introduced in the longitudinal direction. DE 44 39 105 C1 is the subject of FIG. 5 herein.

For the contact blade described in DE 10 2016 007 117 A1, for each contact web an elongated contact opening is introduced on a section of the contact web in the longitudinal direction. For each contact web, the contact opening further divides a section of the contact web into two parallel strips, referred to as contact skids. The sections having the contact openings are situated in each case in an area in which the contact arms or contact webs are bent toward one another and are thus closer to one another. This results in locations at which the contact blade may establish electrical connections with a mating plug-in connector that is insertable between the contact arms. Such locations are referred to as contact points. The contact points are situated approximately in the middle of the lengths of the contact openings. A plug pin having a rectangular cross section is provided as a mating plug-in connector.

In comparison to the contact blade of DE 44 39 105 C1, the number of contact points is doubled in the contact blade of DE 10 2016 007 117 A1, thus improving the properties of the electrical connection to a mating plug-in connector. It is thus possible to achieve lower contact resistances and a more robust electrical connection under difficult environmental conditions (shocks, vibrations).

However, due to the division of the contact webs in some sections into two mutually parallel contact skids, provided in DE 10 2016 007 117 A1, the contact points situated on the outer contact skids rest quite close to the side edges of the contact arms. As the result of an unfavorable tolerance position of the plug pin and the plug-in connector part or contact blade with respect to one another, a contact point on an outer contact skid may contact only one edge of the plug pin instead of the surface thereof. Unlike surface contact, such contacting of the plug pin at an edge may not form a reliable point of contact.

SUMMARY

An object of the present invention is to improve a generic contact blade and a plug-in connector having such a contact blade in a simple and cost-effective manner regarding the mechanical and electrical contact reliability.

An embodiment provides a contact blade for a socket-like, plug-in connector part. The contact blade is formed as a sheet metal strip bent substantially in a U-shape. The sides of the U form two mutually opposed, identical contact arms. The contact arms run towards each other in a central section of their length. Each contact arm is divided into two parallel, adjacent contact webs (pieces) by a primary opening (indentation, slot, incision) running over most of the length of the contact arm. In the region in which the contact arms are closest, a contact opening (indentation, slot, incision) is made in each of the contact webs in the longitudinal direction thereof. The contact openings of each contact arm extend in the longitudinal direction parallel with the primary opening of the contact arm. The contact openings are shorter than the primary opening. Each contact web therefore forms two contact skids on respective sides of the contact opening of the contact web. One of the contact skids of each contact web is an "inner" contact skid in that this contact skid is on the side of the contact opening of the contact web nearest the primary opening. The other one of the contact skids of each contact web is an "outer" contact skid in that this contact skid is on the side of the contact opening of the contact web nearest the side edge of the contact arm having the contact web. The contact openings of each contact web each have a transverse bulge towards the middle of the contact arm. As such, the outer contact skids on each contact arm together with a bulge form a widened section in each case.

Another embodiment provides a socket-like, plug-in connector part having the contact blade.

In embodiments, the above-stated object of improving a generic contact blade is achieved by the contact openings each having a transverse bulge toward the middle of each contact arm, because of which the outer contact skids on each contact arm in each case form a widened section next to a transverse bulge.

Thus, the provided change from the design described in DE 10 2016 007 117 A1 is not to guide the contact openings completely linearly, but, rather, to provide each contact opening with a transverse bulge.

Due to the changed shape of the contact openings, the shape of the contact skids also changes. Because of the transverse bulges of the contact openings, the outer contact skids next to the bulges are now widened. This allows the position of the outer contact points to be moved inwardly, i.e., away from the edges of the contact arms. These contact points will therefore reliably contact the surface of the plug pin. It is also advantageous that the contour of the punching stamp for producing the contact openings may have a much more robust design compared to an originally straight stamp, and the stamp thus has a longer service life and results in cost savings.

BRIEF DESCRIPTION OF THE DRAWINGS

Further advantageous embodiments and refinements of the present invention result from the following description of an exemplary embodiment described below with reference to the drawings in which.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
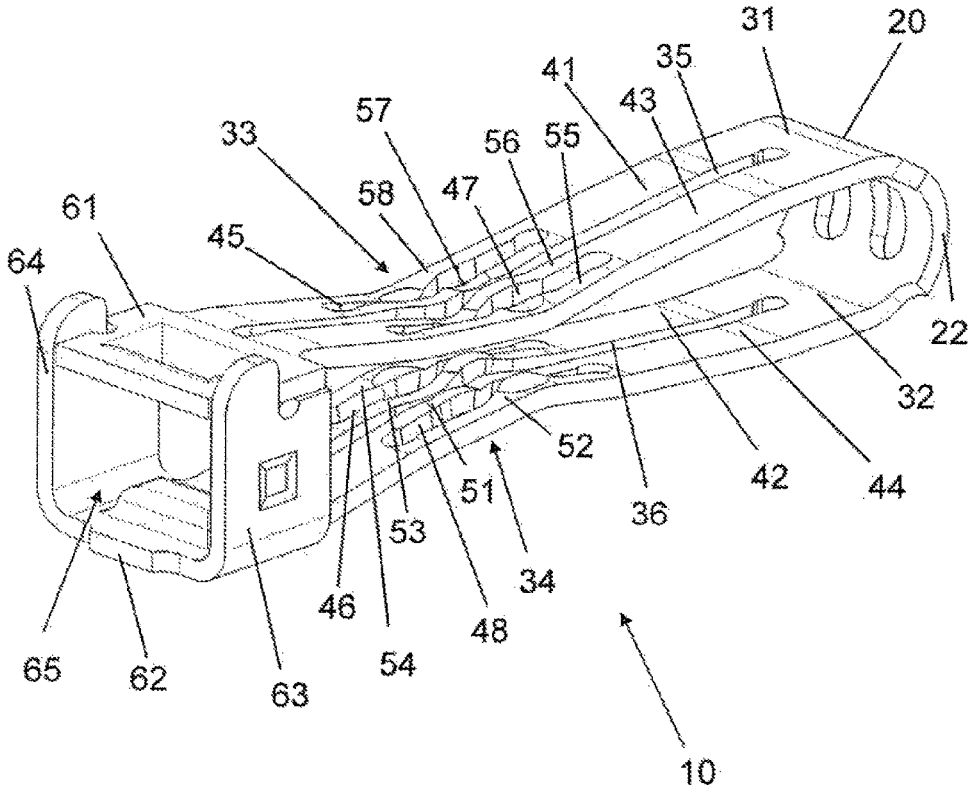
FIG. 1 illustrates a contact blade according to an embodiment of the present invention.

Referring now to FIG. 1, a contact blade 10 according to an embodiment of the present invention is shown. Contact blade (contact lamella) 10 is a resilient contact blade for a socket-like, plug-in connector part.

Contact blade 10 is formed in one piece from a sheet metal strip 20 as a stamped/bent part. For forming contact blade 10, sheet metal strip 20 pre-shaped by stamping has been bent into a U shape. The resulting U legs form two oppositely situated contact arms 31, 32. Contact arms 31, 32 extend from respective ends of bent region 22 of the U shape. Contact arms 31, 32 are not oriented in parallel to one another over the entire length. Instead, contact arms 31, 32 are spaced apart from one another by varying amounts in the longitudinal direction over their length. The spacing between contact arms 31, 32 is at a minimum in middle sections 33, 34 of their lengths.

As further shown in FIG. 1, middle sections 33, 34 of contact arms 31, 32 do not necessarily coincide with the geometric centers of contact arms 31, 32. Rather, the "middle" designation refers to the location of sections 33, 34 of contact arms 31, 32 as being between (i) bending region 22 and (ii) end sections 61, 62 of contact arms 31, 32.

End sections 61, 62 of contact arms 31, 32 are laterally connected to one another by integrally formed webs 63, 64. Webs 63, 64 are bent at a right angle. Webs 63, 64 connect with end sections 61, 62 of contact arms 31, 32 to form a frame-shaped entrance area 65. Frame-shaped entrance area 65 is a receptacle for receiving a plug pin that is part of a complementary plug-in connector part.

Each contact arm 31, 32 over most of its length has a primary opening (incision, indentation, slot) 35, 36. Opening 35 divides contact arm 31 into two adjacent contact webs (contact bridges) 41, 43. Likewise, opening 36 divides contact arm 32 into two adjacent contact webs 42, 44. Additional openings (incisions, indentations, slots) are respectively introduced into contact webs 41, 42, 43, 44 in the area of middle sections 33, 34 of contact arms 31, 32. These additional openings are referred to herein as contact openings. Particularly, a contact opening 45 is in contact web 41 of contact arm 31; a contact opening 46 is in contact web 42 of contact arm 32; a contact opening 47 is in contact web 43 of contact arm 31; and a contact opening 48 is in contact web 44 of contact arm 32.

Contact openings 45, 46, 47, 48 are much shorter than openings 35, 36. Contact openings 45, 46, 47, 48 respectively divide contact webs 41, 42, 43, 44 into two contact skids. Particularly, contact opening 45 divides contact web 41 of contact arm 31 into two contact skids 57, 58; contact opening 46 divides contact web 42 of contact arm 32 into two contact skids 53, 54; contact opening 47 divides contact web 43 of contact arm 31 into two contact skids 55, 56; and contact opening 48 divides contact web 44 of contact arm 32 into two contact skids 51, 52.

Figure 2:
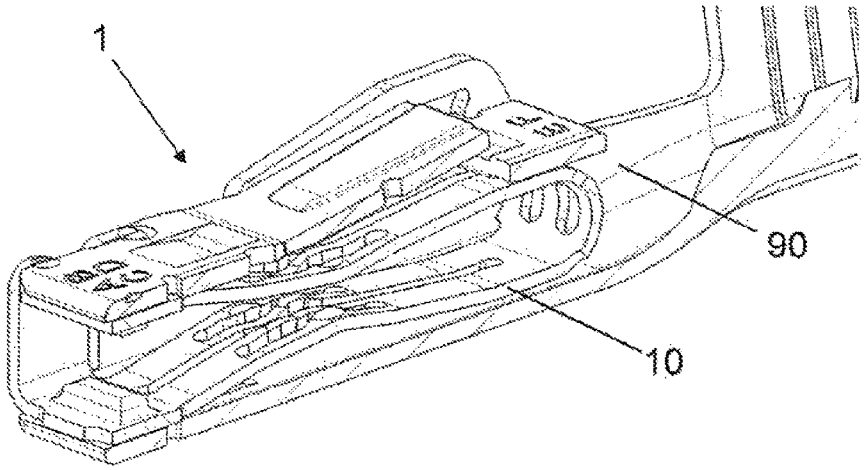
FIGS. 2 and 3 each illustrate a partial, cross-sectional view of a plug-in connector part having the contact blade.
Figure 3:
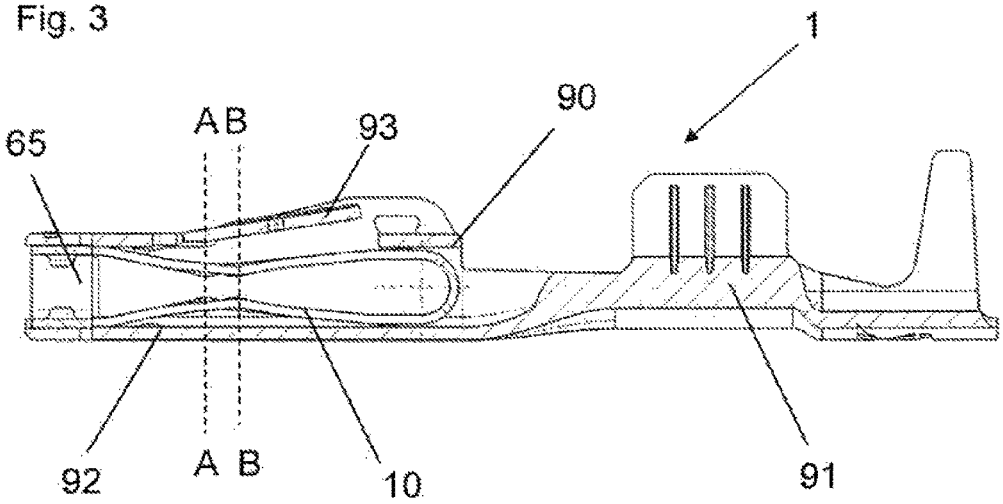

FIGS. 2 and 3 each show a plug-in connector part 1 having contact blade 10. Plug-in connector part 1 is made up of a one-piece base body 90. One-piece base body 90 is functionally divided into a connecting section 91 and a contact section 92. Connecting section 91 is designed here as a crimping section and is used to close off a connecting line (not illustrated), whose conductor leads are connectable to connecting section 91 via a crimping operation.

Contact section 92 adjoining connecting section 91 has a box-shaped design, and in FIGS. 2 and 3 is illustrated in a sectional view along its longitudinal direction. A resilient latching lance 93 that assists with fastening plug-in connector part 1 in a housing body (not illustrated), made of an insulation material, is integrally formed on the top side of contact section 92. Box-shaped contact section 92 forms a cavity into which a contact blade 10 is inserted.

Thus, the overall plug-in connector part 1 is made up of two components, namely, base body 90 and contact blade 10, each having a one-piece design. The frame-shaped entrance area 65 of contact blade 10 ends in flush alignment with the entrance opening of contact section 92 of base body 90.

Figure 4:
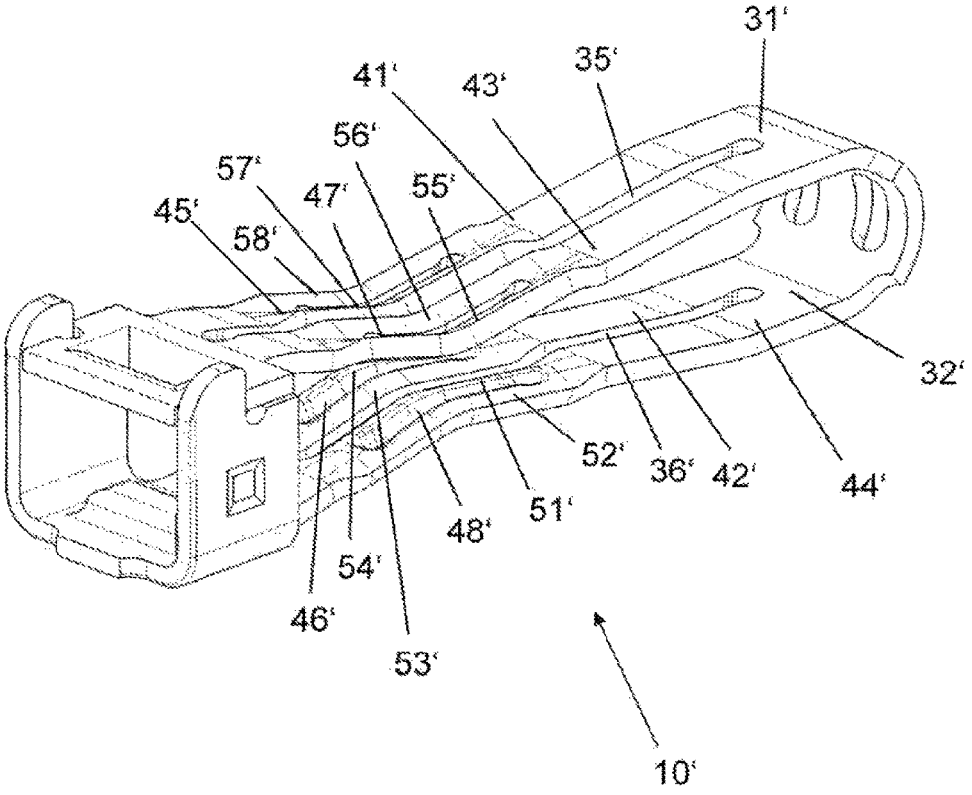
Fig. 4 PRIOR ART
FIG. 4 illustrates a contact blade according to first prior art.

For comparison with contact blade 10 shown in FIG. 1, FIG. 4 illustrates a contact blade 10' according to first prior art, as detailed in DE 10 2016 007 117 A1. Contact blade 10' shown in FIG. 4, unlike contact blade 10 shown in FIG. 1, has primary openings 35', 36' that are guided completely linearly (i.e., completely rectilinear) over the longitudinal direction of contact arms 31', 32'. Further, contact blade 10' shown in FIG. 4, unlike contact blade 10 shown in FIG. 1, has contact openings 45', 46', 47', 48' that are guided completely linearly in contact webs 41', 42', 43', 44'. This results in an arrangement of essentially rectangular contact skids 51', 52', 53', 54', 55', 56', 57', 58'. Contact skids 51', 52', 53', 54' are schematically illustrated for contact arm 32' in FIG. 6.

Figure 5:
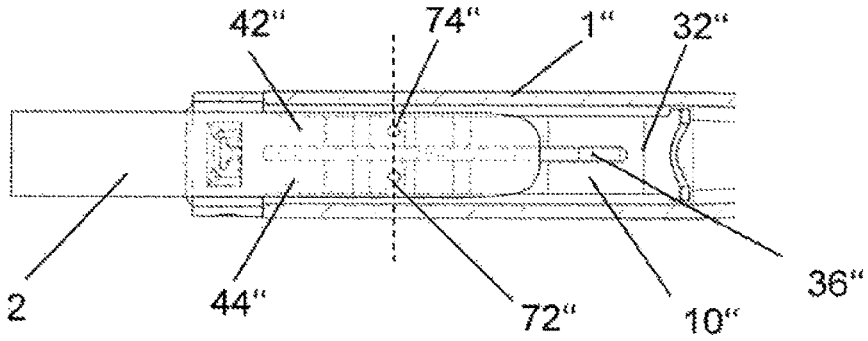
Fig. 5 PRIOR ART
FIG. 5 illustrates a top view of the contact blade according to second prior art.
Figure 6:
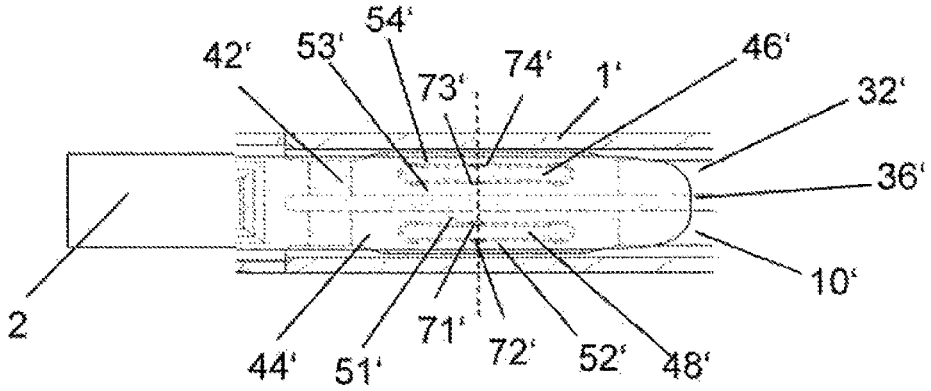
Fig. 6 PRIOR ART
FIG. 6 illustrates a top view of the contact blade according to the first prior art shown in FIG. 4.
Figure 7:
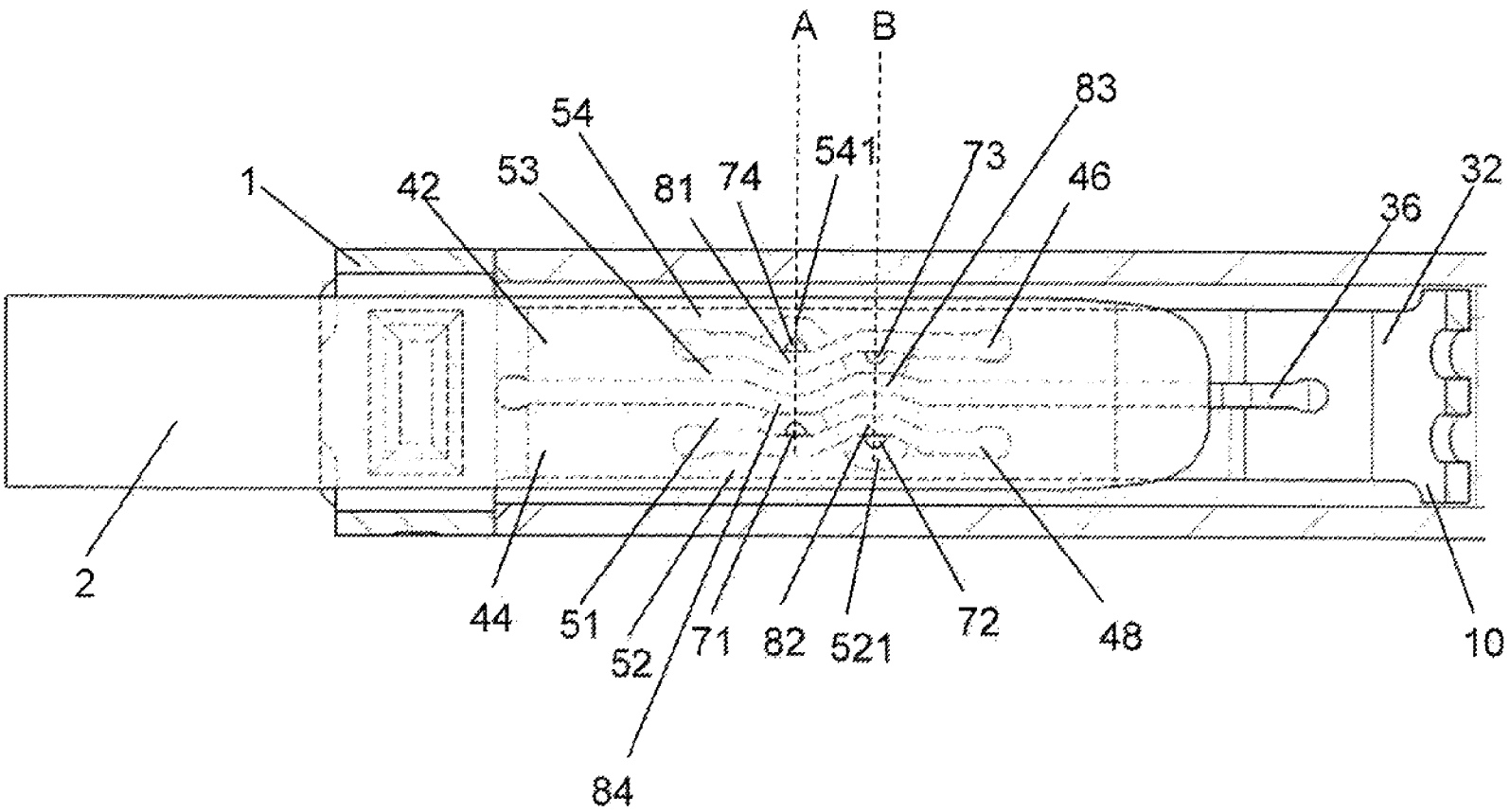
FIG. 7 illustrates a top view of the contact blade according to the embodiment of the present invention.

With reference to FIGS. 5, 6, and 7, the problem leading to the present invention is explained in greater detail by comparing various designs of contact blades 10", 10', 10 to one another. FIG. 5 illustrates a top view of contact blade 10" according to second prior art, as detailed in DE 44 39

105 C1; FIG. 6 illustrates a top view of contact blade 10' according to the first prior art, as detailed in DE 10 2016 007 117 A1; and FIG. 7 illustrates a top view of contact blade 10 according to the embodiment of the present invention. Correspondingly, FIGS. 5, 6, and 7 respectively show a horizontal cross section of a plug-in connector part 1", 1', 1 with an inserted plug pin 2. Each plug pin 2 is transparently illustrated to make the location of contact points 71, 72, 73, 74; 71', 72', 73', 74'; 72", 74" below the inserted plug pin 2 discernible.

As indicated, FIG. 5 shows contact blade 10" having a design known from DE 44 39 105 C1. Contact blade 10" has an opening 36" in a contact arm 32". Opening 36" divides contact arm 32" into two contact webs 42", 44", designed as rectangular strips. A contact point 74", 72" is mounted on each contact web 42", 44" in the middle of its transverse extension. Contact points 74", 72" contact a flat plug 2 inserted into contact blade 10".

As indicated, FIG. 6 shows contact blade 10' having a design known from DE 10 2016 007 117 A1. In contact arm 32', each contact web 42', 44' is additionally divided in each case into two contact skids 53', 54' and 51', 52', respectively, by a shorter contact opening 46', 48' that is introduced in parallel to opening 36'. Since each of contact skids 51', 52', 53', 54' has a contact point 71', 72', 73', 74', this results in four contact points per contact arm. Due to the number of contact points, which is twice that in the design of contact blade 10" in FIG. 5, the electrical properties are basically improved compared to the design illustrated in FIG. 5.

However, it is apparent in the schematic illustration in FIG. 6 that contact points 72', 74' are situated on the outer contact skids 52', 54' relatively farthest to the outside, i.e., near the edges of contact arm 32'. As a result, it is possible that, with an unfavorable tolerance position of an inserted plug pin 2, at least one of outer contact points 72', 74' may come to rest not on the surface, but, rather, on an edge section of flat plug pin 2, thus greatly impairing the electrical connection properties.

To solve the described problem, for contact blade 10 according to the present invention illustrated in FIG. 7 it is provided to move the two outer contacts 74, 72 laterally inward toward the approximate middle of contact arm 32. This is achieved in that the two contact openings 46, 48 do not have a completely linear design, but instead have an inward transverse bulge (protuberance) 81, 82 in each case. Bulges 81, 82 each allow widened sections 541, 521 of contact skid 54, 52 next to bulges 81, 82 to have a slightly wider design. Consequently, more space is available there in each case for a stamped contact point 74, 72, which may be moved correspondingly further laterally inward toward the middle of contact arm 32.

To be able to form inward transverse bulges 81, 82 respectively on contact webs 42, 44 of contact arm 32, bulges 81, 82 are offset relative to one another in the longitudinal direction of contact arm 32. A contact point 74 is situated on outer contact skid 54 of contact web 42; a contact point 72 is situated on outer contact skid 52 of contact web 44; a contact point 73 is situated on inner contact skid 53 of contact web 42; and a contact point 71 is situated on inner contact skid 51 of contact web 44. Contact points 74, 71 are situated at the same height along a line A of the longitudinal extension. Contact points 73, 72 are situated at the same height along a line B of the longitudinal extension. Lines A, B are parallel to one another.

To be able to introduce contact openings 46, 48 having inward transverse bulges 81, 82 into contact arm 32, primary opening 36, which divides contact arm 32 into contact webs 42, 44, also is not guided completely linearly, but instead follows the course of contact openings 46, 48. Opening 36 itself thus forms two bulges 83, 84. Correspondingly, opening 36 and contact openings 46, 48 each extend in parallel to one another over the lengths of contact openings 46, 48 in the longitudinal direction of contact blade 10.

Contact points 71, 72, 73, 74 may be formed in contact arm 32 by an embossing stamp in a single work step. The same operation takes place at the same time or subsequently on contact arm 31, illustrated only in FIG. 1, and even prior to the bending/shaping of contact blade 10. Contact arm 31 is likewise configured like contact arm 32.

LIST OF REFERENCE NUMERALS

1, 1', 1" plug-in connector part
2 plug pin
10, 10', 10" contact blade
20 sheet metal strip
22 bent region
31, 32, 31', 32', 32" contact arms
33, 34 middle sections
35, 36, 35', 36'; 36" primary openings (incisions, indentations, slots)
41, 42, 43, 44, 41', 42', 43', 44; 42", 44" contact webs
45, 46, 47, 48, 45', 46', 47', 48' contact openings (incisions, indentations, slots)
51-58, 51'-58' contact skids
521, 541 widened sections
61, 62 end sections
63, 64 webs
65 entrance area
71, 72, 73, 74, 71', 72', 73', 74', 72", 74" contact points
81, 82, 83, 84 bulges
90 base body
91 connecting section
92 contact section
93 latching lance
A, B lines While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A contact blade for a plug-in connector part, the contact blade comprising:

oppositely situated first and second contact arms extending from respective sides of a bent portion in a longitudinal direction;

the first contact arm having a primary opening extending in the longitudinal direction and dividing the first contact arm into first and second contact webs on respective sides of the primary opening;

the first contact web having a first contact opening extending in the longitudinal direction and dividing the first contact web into first inner and first outer contact skids on respective sides of the first contact opening, the first inner contact skid being between the first contact opening and the primary opening and the first outer contact skid being between the first contact opening and an edge of the first contact arm; and wherein the first contact opening has a transverse bulge extending laterally toward the primary opening such that the first outer contact skid has a widened section next to the transverse bulge of the first contact opening.

2. The contact blade of claim 1 wherein:

the contact opening has a length along the longitudinal direction shorter than a length of the primary opening along the longitudinal direction; and the primary opening and the contact opening are parallel along the length of the contact opening.

3. The contact blade of claim 1 wherein:

the second contact web has a second contact opening extending in the longitudinal direction and dividing the second contact web into second inner and second outer contact skids on respective sides of the second contact opening, the second inner contact skid of the second contact web being between the second contact opening and the primary opening and the second outer contact skid of the second contact web being between the second contact opening and an edge of the second contact arm; and wherein the second contact opening has a second transverse bulge extending laterally toward the primary opening such that the second outer contact skid of the second contact web has a widened section next to the second transverse bulge of the second contact opening.

4. The contact blade of claim 3 wherein:

the second contact opening has a length along the longitudinal direction shorter than a length of the primary opening along the longitudinal direction; and the primary opening and the second contact opening are parallel along the length of the second contact opening.

5. The contact blade of claim 1 further comprising:

a first contact point for contacting a plug pin inserted between the first and second contact arms, wherein the first contact point is on the widened section of the outer contact skid.

6. The contact blade of claim 5 further comprising:

a second contact point for contacting a plug pin inserted between the first and second contact arms, wherein the second contact point is on the inner contact skid.

7. The contact blade of claim 6 wherein:

the second contact web has a second contact opening extending in the longitudinal direction and dividing the second contact web into second inner and second outer contact skids on respective sides of the second contact opening, the second inner contact skid of the second contact web being between the second contact opening and the primary opening and the second outer contact skid of the second contact web being between the second contact opening and an edge of the second contact arm; and wherein the second contact opening has a second transverse bulge extending laterally toward the primary opening such that the second outer contact skid of the second contact web has a widened section next to the second transverse bulge of the second contact opening.

8. The contact blade of claim 7 further comprising:

a third contact point for contacting a plug pin inserted between the first and second contact arms, wherein the third contact point is on the widened section of the outer contact skid of the second contact web.

9. The contact blade of claim 8 further comprising:

a fourth contact point for contacting a plug pin inserted between the first and second contact arms, wherein the fourth contact point is on the inner contact skid of the second contact web.

10. The contact blade of claim 9 wherein:

the first and fourth contact points are located on a first line extending transversely to the longitudinal direction.

11. The contact blade of claim 10 wherein:

the second and third contact points are located on a second line extending transversely to the longitudinal direction, wherein the first and second lines are located at respective locations along the longitudinal direction.

12. The contact blade of claim 11 wherein:

the first contact arm and the second contact arm approach one another in a middle section of their lengths; and the contact openings of the contact webs of the first contact arm are in the middle section of the first contact arm.

13. The contact blade of claim 12 wherein:

the first contact arm and the second contact arm are identical.

14. The contact blade of claim 1 wherein:

the first contact arm, the second contact arm, and the bent portion are formed as one piece from a metal.

15. A plug-in connector part comprising:

a one-piece base body that forms a connecting section and a box-like contact section; and a contact blade that is insertable into the box-like contact section, the contact blade having oppositely situated first and second contact arms extending from respective sides of a bent portion in a longitudinal direction;

the first contact arm having a primary opening extending in the longitudinal direction and dividing the first contact arm into first and second contact webs on respective sides of the primary opening;

the first contact web having a contact opening extending in the longitudinal direction and dividing the first contact web into inner and outer contact skids on respective sides of the contact opening, the inner contact skid being between the contact opening and the primary opening and the outer contact skid being between the contact opening and an edge of the first contact arm;

wherein the contact opening has a transverse bulge extending laterally toward the primary opening such that the outer contact skid has a widened section next to the transverse bulge of the contact opening; and wherein the second contact arm is identical to the first contact arm.

16. The plug-in connector part of claim 15 wherein:

the contact opening has a length along the longitudinal direction shorter than a length of the primary opening along the longitudinal direction; and the primary opening and the contact opening are parallel along the length of the contact opening.

17. The plug-in connector part of claim 16 wherein:

the contact blade further has a first contact point and a second contact point for contacting a plug pin inserted between the first and second contact arms, wherein the first contact point is on the widened section of the outer contact skid and the second contact point is on the inner contact skid.

18. The plug-in connector part of claim 17 wherein:

the second contact web has a second contact opening extending in the longitudinal direction and dividing the second contact web into inner and outer contact skids on respective sides of the second contact opening, the inner contact skid of the second contact web being between the second contact opening and the primary opening and the outer contact skid of the second contact web being between the second contact opening and an edge of the second contact arm; and wherein the second contact opening has a second transverse bulge extending laterally toward the primary opening such that the outer contact skid of the second contact web has a widened section next to the second transverse bulge of the second contact opening.

19. The plug-in connector part of claim 18 wherein:

the contact blade further has a third contact point and a fourth contact point for contacting a plug pin inserted between the first and second contact arms, wherein the third contact point is on the widened section of the outer contact skid of the second contact web and the fourth contact point is on the inner contact skid of the second contact web.

20. The plug-in connector part of claim 19 wherein:

the first and fourth contact points are located on a first line extending transversely to the longitudinal direction, the second and third contact points are located on a second line extending transversely to the longitudinal direction, and the first and second lines are located at respective locations along the longitudinal direction.

* * * * *